US006000915A

United States Patent [19]

Hartman

[11] Patent Number: 6,000,915

[45] Date of Patent: Dec. 14, 1999

[54] MECHANISM FOR PROVIDING MOTIVE FORCE AND FOR PUMPING APPLICATIONS

[75] Inventor: Michael G. Hartman, Kirkland, Wash.

[73] Assignee: Centiflow LLC, Kirkland, Wash.

[21] Appl. No.: 09/005,170

[22] Filed: Jan. 9, 1998

Related U.S. Application Data

[63] Continuation-in-part of application No. 08/844,576, Apr. 18, 1997.

[51] Int. Cl.[6] ..... F04B 35/04

[52] U.S. Cl. ..... 417/356; 417/423.5; 166/105

[58] Field of Search ..... 166/105, 106; 417/355, 356, 423.3, 423.5

[56] References Cited

U.S. PATENT DOCUMENTS

| | | | |
|---|---|---|---|
| 242,400 | 5/1881 | Voelker | 417/356 |
| 534,428 | 2/1895 | Dean | 415/73 |
| 562,480 | 6/1896 | McMurrin . | |
| 815,302 | 3/1906 | Marvin | 415/73 |
| 979,041 | 12/1910 | Smith | 415/75 |
| 1,459,453 | 7/1921 | Trigwell . | |
| 1,816,971 | 8/1931 | Hoff et al. . | |
| 2,500,400 | 3/1950 | Cogswell | 417/355 |
| 2,697,986 | 12/1954 | Meagher, Jr. | 417/356 |
| 2,747,512 | 5/1952 | Fouche | 103/87 |
| 3,972,653 | 8/1976 | Travis et al. | 417/356 |
| 4,145,383 | 3/1979 | Randall | 261/29 |
| 4,170,436 | 10/1979 | Candler | 415/73 |
| 4,500,254 | 2/1985 | Roznieckі | 415/75 |
| 4,957,504 | 9/1990 | Chardack | 623/3 |
| 5,017,087 | 5/1991 | Sneddon | 415/72 |
| 5,088,899 | 2/1992 | Blecker et al. | 417/356 |
| 5,205,721 | 4/1993 | Isaacson | 417/356 |
| 5,209,650 | 5/1993 | Lemieux | 417/356 |
| 5,290,227 | 3/1994 | Pasque | 600/16 |
| 5,336,070 | 8/1994 | Fujiwara et al. | 418/220 |
| 5,366,341 | 11/1994 | Marino | 415/6 |
| 5,484,266 | 1/1996 | Murga | 417/355 |
| 5,505,594 | 4/1996 | Sheehan | 417/420 |
| 5,527,159 | 6/1996 | Bozeman, Jr. et al. | 417/45 |
| 5,620,048 | 4/1997 | Beauguin | 417/423.3 |

FOREIGN PATENT DOCUMENTS 452538 10/1991 European Pat. Off. .

OTHER PUBLICATIONS

Book by Tyler G. Hicks, entitled "Pump Selection and Application", 1957 title page included for convient reference, and p. 340.

*Primary Examiner*—Charles G. Freay
*Attorney, Agent, or Firm*—Zackery, Furrer & Tezak

[57] ABSTRACT

Provided in accordance with the principles of the present invention, in one preferred embodiment, is a pumping system (90). The system includes a housing (108) rotatably supporting a tube (112), with a plurality of magnets (116) located around the tube. The magnets create magnetic forces that cause the tube to rotate. The system further includes a pump (94) connected to the tube. When the tube rotates, the pump receives rotational mechanical energy, which operates the pump. Additionally, the tube and pump are connected in fluid communication such that fluid flows through the pump and the tube, when the system operates to pump a fluid. Preferably, the outlet end (98) of the pump connects to the tube in the system so that fluid first flows through the pump, and then through the tube.

22 Claims, 5 Drawing Sheets

MECHANISM FOR PROVIDING MOTIVE FORCE AND FOR PUMPING APPLICATIONS

CROSS-REFERENCE TO RELATED APPLICATION

This application is a continuation-in-part application of prior copending application, Ser. No. 08/844,576, filed Apr. 18, 1997, the benefit of the filing date of the prior application of which is hereby claimed under 35 U.S.C. § 120.

FIELD OF THE INVENTION

The present invention relates generally to motors, and in particular, to pumping systems.

BACKGROUND OF THE INVENTION

Pumps have been important to human civilization since virtually the dawn of recorded history. People have almost always had some need to transport a fluid from one location to another. Humans probably invented the first pump in connection with the need for irrigating crops, and/or for supplying a settlement with water. Since that time, people have applied pumps to meet other fluid transportation needs, such as removing oil from wells, circulating refrigerant through cooling systems, pressurizing air for use in pneumatic systems, which are just a few examples of the many applications for pumps.

A problem common to all pumps has been maximizing the fluid flow rate through a pump for a given size/weight of pump, i.e., maximizing pumping efficiency. For urging a fluid to flow, there are three general types of pump actions: (i) positive displacement, (ii) centrifugal action, and (iii) axial. In any of the systems, the result is to urge fluid to flow in a particular direction.

Any pump of course require a motor, i.e., some mechanism for supplying the motive force for causing positive displacement, centrifugal action or axial motion within the pump.

Generally, the systems employ a non-integral motor. That is, a motor connects through a shaft, gearing, roller, or other mechanical arrangement, and supplies the motive force for causing positive displacement, centrifugal action or axial flow within a pump. While satisfactory for many applications, the mechanical arrangement coupling the motor to the fluid flow mechanism in a pumping system necessarily introduces costs and inefficiencies. For instance, all coupling mechanisms are costly, are susceptible to breakdown, take up space, add weight to the pumping system, and cause frictional losses.

Prior patents have disclosed pumping arrangements employing an integral motor (see, e.g. U.S. Pat. No. 3,972,653 to Travis, or U.S. Pat. No. 5,017,087 to Sneddon). Basically, these arrangements have an electric motor in which the rotor shaft is hollow. An impeller system essentially mounts within the rotor shaft, and rotates with the shaft when the motor is operated, causing fluid to flow through the hollow shaft. Stationary magnets mounted to the motor housing, produce magnetic forces that cause the hollow shaft to rotate.

While such arrangements address at least some problems inherent to pumping systems having non-integral motors, integral pump-and-motor arrangements have not found wide-spread commercial acceptance. For instance, the present inventor is not aware of any integral pump-and-motor arrangement employed for removing oil or water from a well. The same applies to sump pumps, and in agricultural uses, for pumping water from irrigation sources.

The lack of commercial success likely stems from one main reason. Non-integral motor/pump systems dominate these industries, and function reasonably well. Absent clear and compelling advantages, the industries are reluctant to invest in unproven technology. While prior references broadly disclose integral motor/pump arrangements, generally there is no teaching or suggestion of devices having immediate, clear advantages over existing pump systems.

Moreover, prior references generally do not disclose mechanisms easily integrated with the existing pump systems. Specifically, prior references typically disclose devices incapable of being advantageously incorporated into existing non-integral motor/pump arrangements. Such mechanisms are thus prevented from establishing a niche in existing markets, i.e., the mechanisms are not able to gain a "toe-hold," despite possible advantages of these devices.

The present invention provides improved mechanisms related to, or incorporating integral motor/pump arrangements, particularly adapted to specific applications. The mechanisms provide immediate, clear, advantages over existing systems, and/or more readily provide for integration with existing systems.

SUMMARY OF THE INVENTION

A mechanism, provided in accordance with the principles of the present invention, in a preferred embodiment, functions in general for providing motive force. Additionally, the mechanism is specially adapted for pumping applications, having an impeller/pumping section integral with a drive system. The integral arrangement improves efficiency, as it avoids the losses inherent in prior pumping systems that have essentially separate motor and pumping sections. Further, the integral arrangement results in substantial fluid flow through the drive system, resulting in greater cooling for the drive system, when using the mechanism in motor applications, i.e., for providing motive force for another device.

The mechanism includes a housing, and a tube rotatably mounted within the housing. Specifically, the tube mounts in the housing for rotation of the tube relative to the housing, substantially about the tube's longitudinal axis. A power or drive system acts upon the tube, causing the tube to rotate relative to the housing.

The drive system includes a plurality of magnets mounted within the housing, located around the tube, for creating magnetic forces for causing the tube to rotate. More particularly, magnets preferably mount to both the tube and the housing. The magnets create interacting magnetic forces, as in a conventional electric motor, for causing rotation of the tube. In other preferred embodiments, the tube may not necessarily include magnets, and is driven via induction from magnets mounted in the housing, as in a conventional induction electric motor.

One or more impellers mount to the tube. The impellers are adapted to cause fluid flow through the tube when the tube rotates. Thus, tube rotation via the drive system, causes fluid flow through the tube. Fluid enters the housing through an inlet at one end of the housing, and discharges through an outlet at the other end of the housing. In at least one preferred embodiment, the inlet and outlet are defined at positions in the housing, located away from, and being non-aligned with, the longitudinal axis of the tube. In yet another preferred embodiment, there is a fluid flow path defined in the housing at least partially along the tube's external surface, and at least partially through the tube.

In still another preferred embodiment, at least one end of the tube extends through the housing exterior wall, for connection of the tube end to another device. More particularly, the tube connects to the other device, for providing rotational mechanical energy to the other device. That is, for functioning as a motor for the other device.

In a modification to the arrangement described in the preceding paragraph, a shaft supports the tube in another preferred embodiment. In this arrangement, the housing rotatably supports the shaft for permitting rotation of the tube. At least one shaft end extends beyond the exterior of the housing to connect to another device for functioning as a motor for that device.

In yet another preferred embodiment, a system includes a tube in a device as previously described, but without necessarily having impellers. The mechanism couples to a pump in the system, and functions as a power or drive mechanism for the pump. In operation, the tube rotates and supplies rotational mechanical energy to the pump for operating the pump. The pump is also connected in fluid communication with the tube such that when the systems pumps a fluid, the fluid flows through the pump and the tube. Preferably, the outlet end of the pump connects to the tube so that the fluid first flows through the pump, and then the tube.

In another preferred embodiment, the system described in the preceding paragraph is modified to include a second pump connected to the other end of the power/drive mechanism. One end of the tube in the power/drive mechanism connects to one pump, and the tube's opposite end connects to the other pump. In this configuration, the power/drive mechanism supplies rotational mechanical energy to both pumps. In operation, fluid first flows through one pump, then through the power drive mechanism, and finally through the other pump.

In the foregoing two embodiments, the power/drive mechanism effectively functions as a "flow-through" motor. That is, the power/drive mechanism operates a pump or pumps, with fluid flowing through the power/drive mechanism and the pump or pumps. The power/drive mechanism, however, does not necessarily pump the fluid. Rather, the pumping is caused by another element in the system, i.e., a pump or pumps. Optionally, the tubes in the power/drive mechanisms may include impellers, and thus also cause pumping of the fluid.

The present invention thus provides mechanisms that function in general for providing motive force, and in particular, for pumping applications.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 3:
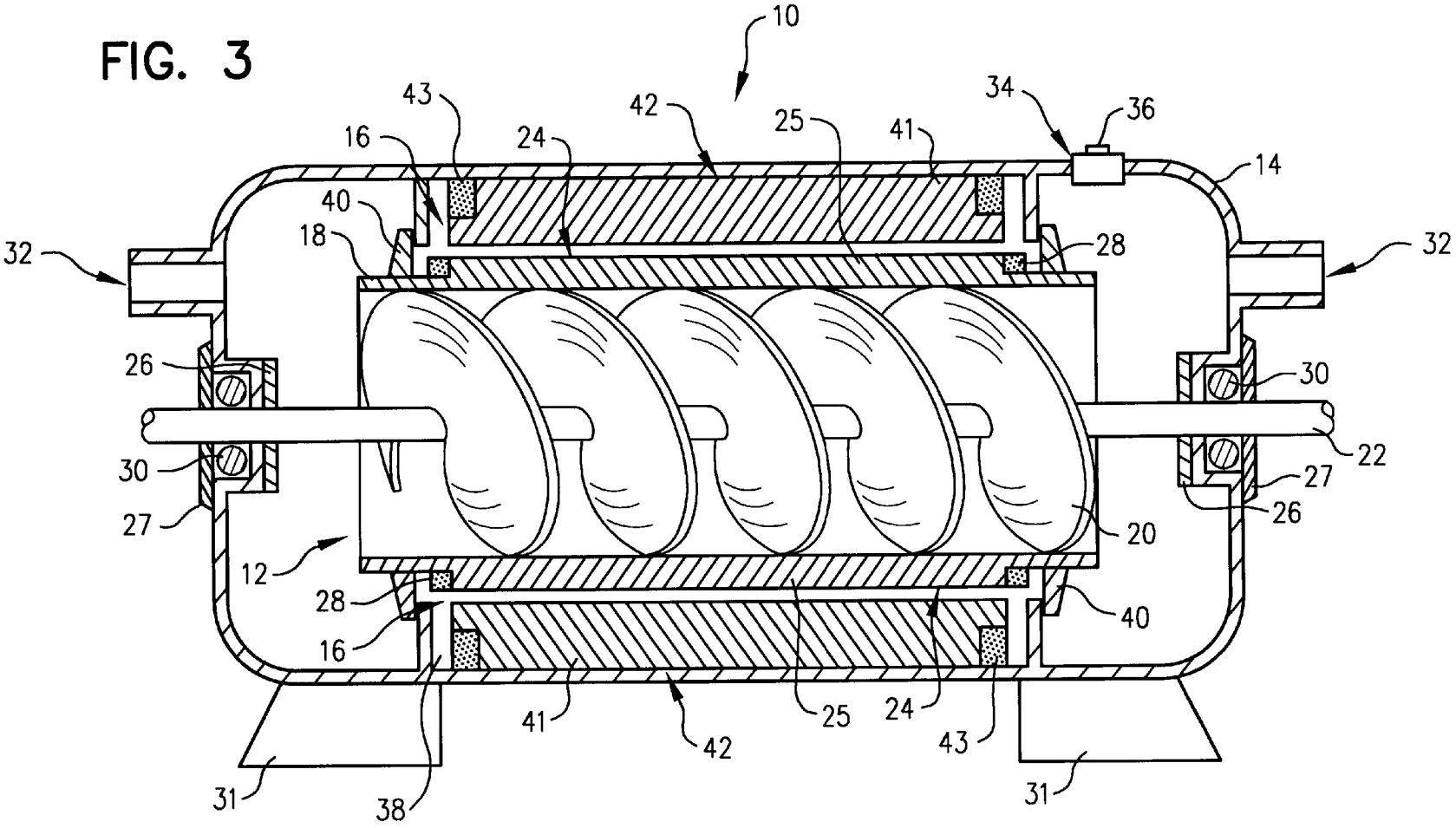
FIG. 3 illustrates a cross-sectional view through a mechanism in accordance with the present invention, incorporating the tube system of FIG. 1, with part of the tube system illustrated via a perspective view.

FIG. 3 illustrates a preferred embodiment of a mechanism 10 in accordance with the present invention. The mechanism 10 functions in general for providing motive force, and is particularly adapted for pumping applications. As discussed in more detail below, the mechanism 10 may be integrated with existing pumping systems having a non-integral motor. Additionally, the mechanism 10 provides for portable use, and advantageously does not require in-line attachment with an existing piping system for pumping applications.

Figure 1:
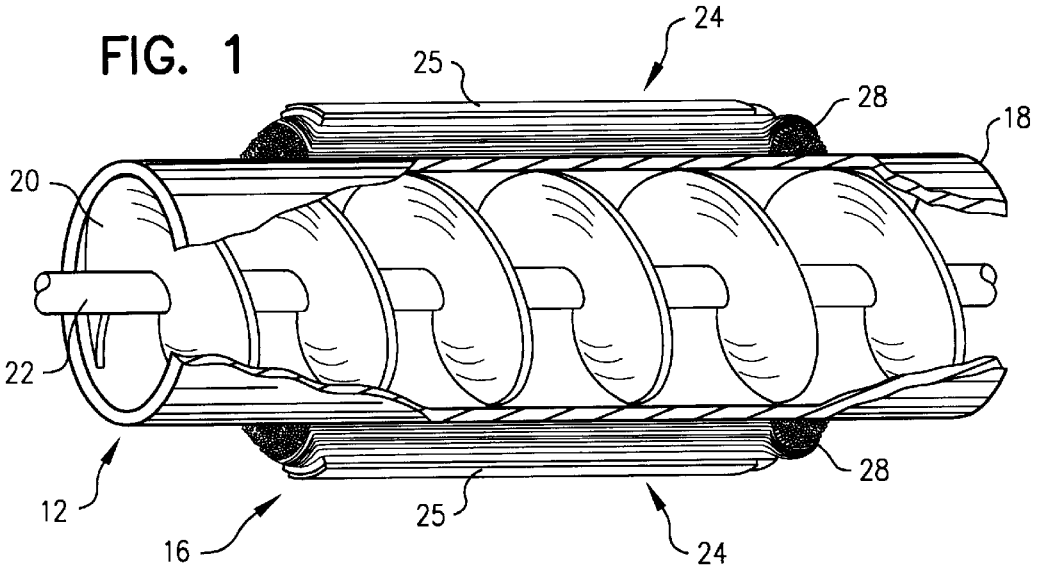
FIG. 1 illustrates a perspective, partial cut-away view of a preferred embodiment of a portion of a tube system in accordance with the present invention.

The major components of the mechanism 10 include: (i) a cylinder or tube system 12; (ii) a housing 14 substantially surrounding or enclosing the tube system; and (iii) a power or drive system 16. FIG. 1 illustrates a view of the tube system 12, shown removed from the housing 14.

The tube system 12 includes a cylinder or tube 18 having impellers 20 running internally along the length of the tube 18. A support shaft 22 extends through the tube 18, substantially along the tube's longitudinal axis. The impellers 20 mount to the tube 18 and to the shaft 22, extending from the shaft to the tube's inner surface, spiraling along the tube's length in a screw conveyor arrangement. When the tube 18 rotates about it's longitudinal axis (and the impellers 20 rotate along with the tube), the impellers act to urge fluid to flow through the tube.

The view shown in FIG. 1 additionally illustrates part of the drive system 16 for causing rotation of the tube 18 about its longitudinal axis. The drive system 16 includes a plurality of magnets 24, mounted to the outer circumference of the tube 18. The magnets 24 are preferably conventional electromagnets, having a core 25, and wiring 28. The magnets 24 are spaced around the outer circumference of the tube 18 at approximately regular intervals as in the arrangement for the electromagnets typically used in the armature for conventional electric motors. A commutator or slip rings (not shown) mount around the outer circumference of the tube 18 for supplying the magnets 24 with electrical power as the tube 18 rotates. The commutator/slip ring arrangement connects to the wiring 28 for the magnets 24, as typically used in a commutator/slip ring arrangement for supplying electrical power to the armature of a conventional electric motor.

Referring to FIG. 3, the tube system 12 rotatably mounts within the housing 14. Conventional bearings 30 at each end of the housing 14 rotatably support the shaft 22. The ends of the shaft 22 extend through the housing exterior wall, and through the bearings 30, which rotatably support the shaft. Each end of the shaft 22 additionally extends through an interior annular seal 26, opposite each bearing 30, within the housing 14. The seals 26 surround the shaft's outer circumference, for forming a seal around the shaft 22. When the shaft 22 rotates, the seals 26 slide around the shaft's exterior, and maintain sealing contact around the shaft circumference, for substantially preventing fluid in the housing 14 from escaping between the housing/shaft interface, and protecting the bearings 30. The ends of the shaft 22 similarly extend through an external annular seal 27 on the opposite side of each bearing 30.

Feet or mounting bases 31 extend from the lower surface of the housing 14. The mounting bases 31 support the mechanism 10 above a surface.

Each end of the housing 14 defines an opening 32 for permitting the mechanism 10 to function as a pump. As discussed earlier, when the tube 18 rotates, and the impellers 20 rotate along with the tube, the rotating impellers urge fluid to flow through the tube. One of the openings 32 functions as an inlet for receiving fluid into the housing 14 and into the tube 18. The other opening 32 functions as an outlet for receiving fluid from the tube 18, and discharging the fluid from the housing 14. The top of the housing 14 additionally includes an opening 34, sealed with a removable plug 36. This opening 34 permits priming of the mechanism 10, wherein the pumping fluid is a liquid. That is, the opening 34 permits filling the interior of the housing 14 with an initial supply of fluid sufficient to initiate pumping of the fluid.

The interior of the housing 14 includes a centrally disposed cylindrical or tubular recess 38. The tubular recess 38 coaxially surrounds the portion of the tube 18 to which magnets 24 mount, and encloses this portion of the tube. In particular, a collar or large annular seal 40 caps each end of the tubular recess 38.

Each end of the tube 18 centrally extends through the annular seal 40, in a sliding fit with the seal's inner circumference, to seal the ends of the tubular recess 38. When the tube 18 rotates, the inner circumference of the seal 40 slides around the tube's exterior, and maintains sealing contact around the tube's exterior. When pumping a liquid fluid, the annular seal 40 thus substantially prevents fluid pumped through the housing 14 and tube 18, from contacting electrical components of the drive system 16.

Stationary magnets 42 mount to the housing 14 within the tubular recess 38, around the tube 18. The stationary magnets 42 also form part of the drive system 16, and are preferably conventional electromagnets, having wiring 43 and a core 41. The stationary magnets 42 mount at approximately regular, circumferential intervals around the tubular recess 38. In operation, the stationary magnets 42 and the tube magnets 24 create interacting magnetic forces that cause the tube 18 to rotate. In particular, the stationary magnets 42 mount in close proximity to the tube magnets 24, as in the arrangement for a conventional electrical motor having stationary magnets mounted in close proximity to magnets mounted on the motor's armature.

As discussed above, the magnets 24 and 42 in the mechanism 10 create interacting magnetic forces, as in a conventional electric motor, and cause the tube 18 to rotate. The impellers 20, rotating with the tube 18, cause fluid flow through the tube. The mechanism 10 thus functions as an integral motor and pump system, drawing fluid in one opening 32, and discharging fluid through the other opening 32.

An advantage of the present mechanism 10, is that it may be used for driving other devices, i.e., the mechanism 10 can function as motor. In this regard, the ends of the shaft 22 project through the exterior of the housing 14 for connection to another device. Specifically, the shaft ends may be mechanically coupled to other devices for providing motive force, i.e., acting as a motor for other devices.

For example, the ends of the shaft 22 may be connected to a conventional pump and function as the pump motor. In this arrangement, the present mechanism 10 may also be "staged" with the pump. That is, the output from the pump can be input into the mechanism 10, or vice versa, so that the mechanism and pump combine to produce a higher volume and/or pressure of fluid flow, than either would produce individually. This provides for ready integration of the mechanism 10 into existing pumping systems having one or more non-integral motors.

Moreover, whenever the mechanism 10 is operating, fluid flows centrally through the tube 18 due to the rotating impellers 20 in the tube 18. This fluid flow results in improved cooling, relative to prior types of electric motors. Applications are contemplated for the mechanism 10 as a motor, where cooling to prevent motor overheating is a significant concern.

The mechanism 10 provides a further advantage in that it does not have to connect "in-line" with an existing piping system. More particularly, prior patents propose integral motor/pumps that generally require the rotational axis of the tubes in these systems to be aligned with the piping system. The mechanism 10 of the present invention has an inlet and outlet 32 positioned at locations away from the rotational axis of the tube 18. That is, the inlet and/or outlet 32 is non-aligned with the tube's longitudinal axis. This structure further facilitates integration into existing systems having one or more non-integral motors.

As the mechanism 10 does not have to be connected "in-line" with an existing piping system, it is portable and provides for "stand-alone" usage. Portability could be enhanced by the provision of an external handle or handles for a person to grasp when maneuvering the mechanism 10.

Mechanisms in accordance with the present invention may employ any suitable type of impeller arrangement for urging fluid flow. Impeller arrangements may be optimized for the type of fluid (e.g., certain impeller arrangements for air or other gases, as opposed to a liquid, or perhaps for highly viscous fluids), desired pumping volume, pressure, and/or other parameters. In particular, FIG. 6 illustrates another preferred embodiment of a mechanism 44 in accordance with the present invention, having a different impeller arrangement.

Figure 6:
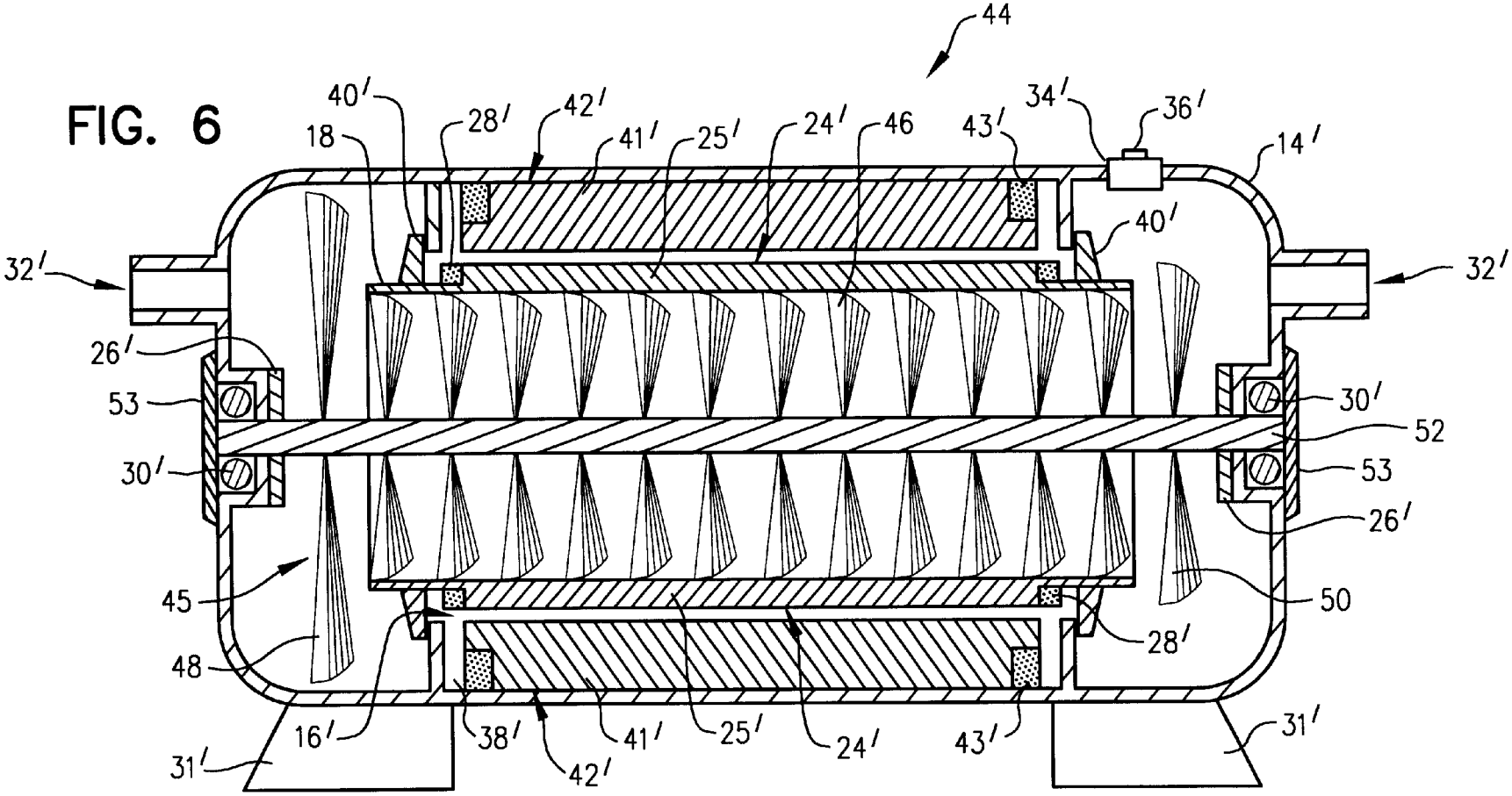
FIG. 6 illustrates another preferred embodiment of a mechanism in accordance with the present invention.

The mechanism 44 shown in FIG. 6 employs several components substantially identical to those for the previously described embodiment. Identical reference numerals are used for the embodiment of FIG. 6 and the previously described embodiment, to indicate substantially identical, corresponding components, with the prime symbol (') following reference numerals for the embodiment of FIG. 6.

The primary external difference in the mechanism 44 of FIG. 6, compared to the previous embodiment, is that the mechanism does not have the ends of a shaft projecting from the device. In this regard, the mechanism 44 of FIG. 6 has not been designed for powering another device, such as a conventional pump (although the mechanism could be modified to do so as discussed in the following paragraphs).

In other aspects, externally, the mechanism 44 generally appears similar to the previously described embodiment. More particularly, the mechanism employs a housing 14' substantially identical to the housing of the previous embodiment. Briefly, mounting bases 31' extend from the housing's lower side for supporting the mechanism 44 above a surface. An opening 32' in each end of the housing 14' permits the mechanism 44 to function as a pump. Specifically, one opening 32' serves as a pump inlet, and the other opening serves as the pump outlet. An opening 34' in the top of the housing 14', sealed with a removable plug 36', permits priming of the mechanism 44 (where the pumping fluid is a liquid). A tubular recess 38' in the housing 14', capped at each end with a large annular seal 40', substantially encloses the drive system 16' for the mechanism 44.

Internally, the mechanism 44 employs a different tube system 45. The tube system 45 employs a tube 18' substantially identical to the tube in the previous embodiment, but has an altered impeller arrangement. Specifically, the impellers 46, 48 and 50 are in the form of spaced apart vanes or blades.

The impellers 46, 48 and 50 radiate from a shaft 52. The shaft 52 extends through the tube 18', substantially along the tube's longitudinal axis. Bearings 30' at each end of the housing 14' rotatably support the shaft 52. In particular, the ends of the shaft 52 extend through the housing exterior wall, and into the bearings 30'. Each end of the shaft 52 additionally extends through an interior annular seal 26', opposite each bearing 30', substantially identical to the interior annular seals of the previous embodiment. A cap seal 53 opposite the side of each bearing 30' adjacent the housing 14', seals the bearings and shaft 52 from the exterior environment. (In alternate embodiments, one or both of the cap seals 53 could be replaced with an annular seal, and the shaft 52 with one having a longer length; there would thus be a projecting shaft end or ends as in the previous embodiment for driving another device, i.e., for functioning as a motor).

Preferably, the impellers 46, 48 and 50 each radiate in assemblages at spaced apart locations along the shaft 52. Each impeller in a group 46, 48 or 50, extends outward at spaced apart positions around the shafts circumference, at the location for that assemblage.

A first set of impellers 46 run internally along the length of the tube 18', extending from the shaft 52 to the tube's inner surface. Larger impellers 48 or 50 extend from the shaft 52, forward and aft of the ends of the tube 18'. The larger impellers 48 and 50, being external to the tube 18', can thus extend for a distance greater than the tube's diameter. Depending on fluid flow considerations, the larger impellers 48 and 50 may extend for the same, or different lengths, for achieving greater pumping efficiency in the mechanism 44. As illustrated, the larger impellers 48 proximate one end of the tube 18' and extend for a greater distance than the impellers 50 proximate the other tube end.

The mechanism 44 includes a drive system 16' substantially identical to the drive system for the previous embodiment. Briefly, the drive system 16' includes a plurality of magnets 24' mounted to the outer circumference of the tube 18'. The magnets 24' are preferably conventional electromagnets, having wiring 28', a core 25', and a commutator/slip ring arrangement (not shown) for supplying the magnets with electrical power when the tube 18' rotates. Stationary magnets 42' mount to the interior of the housing 14' within the tubular recess 38', around the tube 18'. The stationary magnets 42' are also preferably electromagnets, having wiring 43', and a core 41'. In operation, the stationary magnets 42' and the tube magnets 24' create interacting magnetic forces that cause the tube 18' to rotate. In particular, the stationary magnets 42' mount in close proximity to the tube magnets 24', as in the arrangement for a conventional electrical motor having stationary magnets mounted in close proximity to magnets on the motor's armature.

Generally, larger bearings (and seals for protecting the bearings) are more costly. The previously described embodiments employ a shaft for supporting the tube in the mechanism 10 or 44. This arrangement permits the use of smaller bearings. That is, due to the smaller diameter of the shaft, relative to the tube, smaller bearings can be used for rotatable shaft support.

Figure 2:
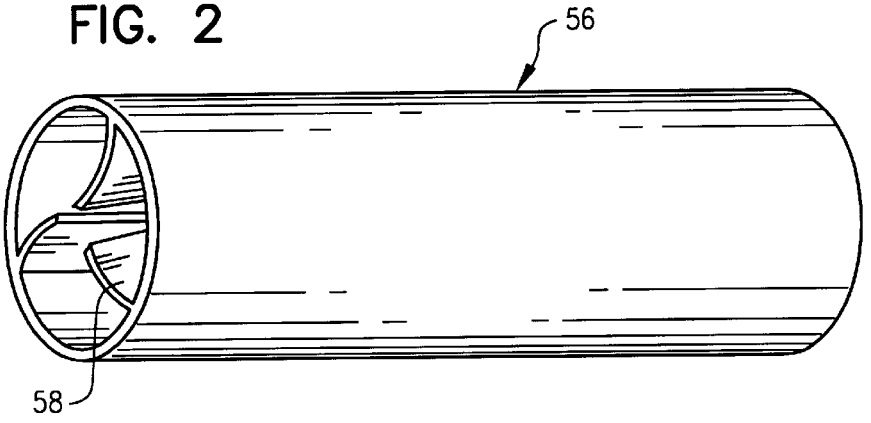
FIG. 2 illustrates another preferred embodiment of a tube in accordance with the present invention, for use in place of the tube in the system of FIG. 1.

In some applications, it may be desirable to employ larger bearings (and larger bearing seals), despite increased costs, for example, in applications requiring maximum pumping efficiency. More particularly, the shaft in the previous embodiments takes up space, and for this reason, arguably decreases the fluid pumping rate through the mechanisms 10 and 44. FIG. 2 illustrates a tube 56 for use in alternate embodiments of these mechanisms, that do not have a shaft.

Specifically, the tube 56 has impellers 58 that do not require support from a central shaft. Instead, the impellers 58 cantilever inward from around the inner circumference of the tube 56. Each impeller 58 forms a curved blade, angling along the tube's length.

The tube 56 may be used to replace tubes 18 or 18' in the previous embodiments, with some modifications. In the modified mechanisms, each end of the tube 56 preferably extends through an end of the mechanism's housing. In operation, fluid thus enters the modified mechanism directly through one end of the tube 56. Similarly, fluid is discharged from the modified mechanism directly from the opposite end of the tube 56. In this arrangement, a large bearing at each end of the housing rotatably supports the tube 56. Preferably, each bearing is sandwiched between a pair of annular seals, similar to annular seals 40 or 40', for protecting the bearings and drive system.

Figure 4:
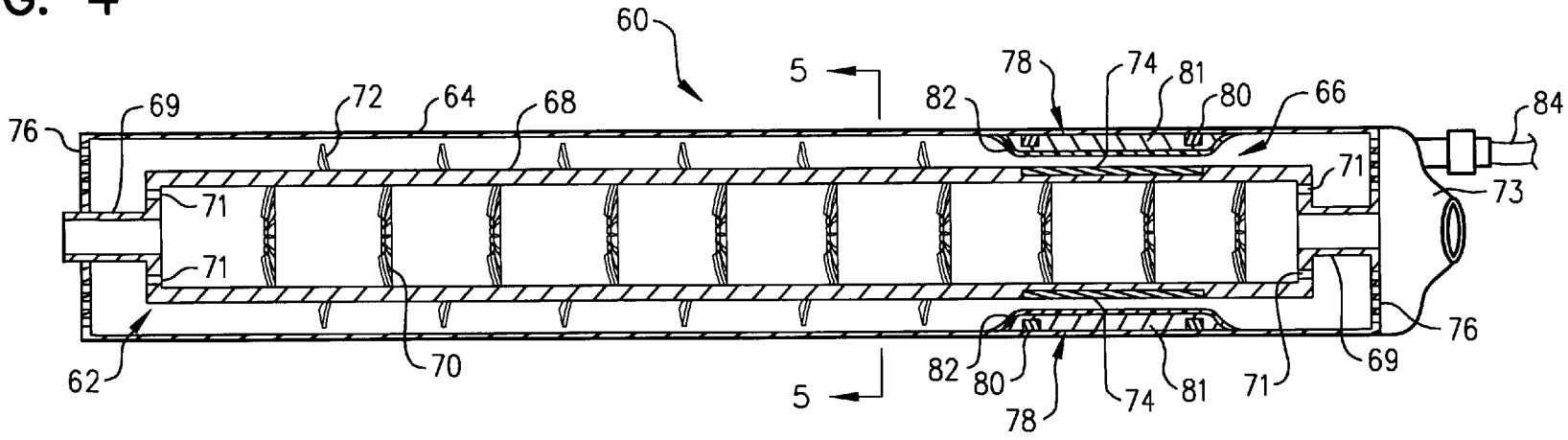
FIG. 4 illustrates a partial cross-sectional view of another preferred embodiment of a mechanism in accordance with the present invention.

FIG. 4 illustrates another preferred embodiment of a mechanism 60 in accordance with the present invention. As discussed in the following paragraphs, the mechanism 60 is specially adapted for submersible well pump applications. The major components of the mechanism 60 include: (i) a cylinder or tube system 62; (ii) a housing 64 substantially surrounding or enclosing the tube system; and (iii) a power or drive system 66.

The tube system 62 includes a cylinder or tube 68, having a narrower diameter portion or neck 69, projecting from each end of the tube. Each neck 69 extends substantially coaxially from its respective end of the tube 68. The necks 69 may be hollow, such that there is path of fluid communication through each neck to the interior of The tube's main body portion. If the necks are hollow, there would be a path of fluid communication defined completely through the tube 68 and the hollow necks 69.

As illustrated, there is an abrupt shoulder at the interface between each neck 69 and the tube's main body portion (the shoulder may include rounding or smoothing of abrupt corners for improved fluid flow efficiency through the mechanism 60 in alternative embodiments). The portion of each shoulder facing along the tube's longitudinal axis includes holes 71, extending through to the interior of the tube's main body portion. The holes 71 thus define paths of fluid communication through each shoulder, from the exterior environment to the interior of the tube's main body portion.

Figure 5:
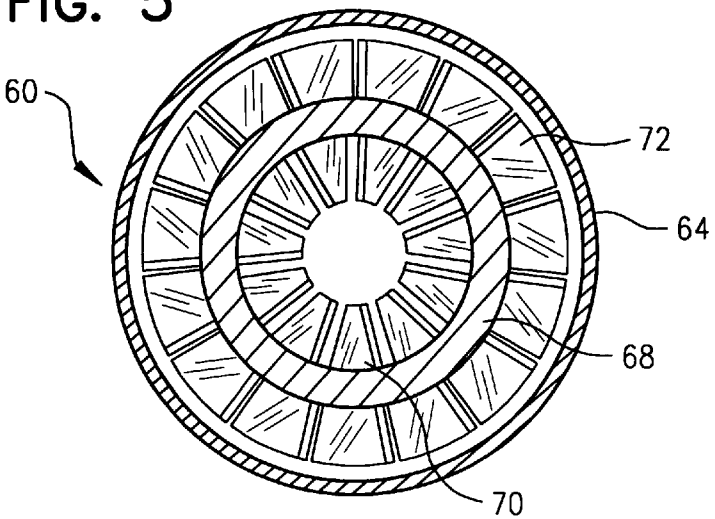
FIG. 5 illustrates a cross-sectional view of the mechanism of FIG. 4, talking along section line 5—5 in FIG. 4.

Internal and external impellers 70 and 72 mount to the main body portion in the tube 68. FIG. 5 illustrates a view of the impellers 70 and 72, along the longitudinal axis of the tube 68. As illustrated, the impellers 70 or 72 are in the form of vanes or blades. When the tube 68 rotates, and the impellers 70 and 72 rotate with the tube, the impellers urge fluid to flow along the tube. The internal impellers 70 cause fluid flow internally through the tube 68, and the external impellers 72 cause fluid flow along the exterior of the tube.

The impellers 70 or 72 preferably mount in either internal or external assemblages at spaced apart locations along the tube's length. Each impeller 70 in an internal assemblage, radiates inward at spaced apart positions around the inner circumference of the tube 68, at the location for that assemblage. Conversely, each impeller 72 in an external assemblage, radiates outward at spaced apart locations around the outer circumference of the tube 68, at the location for that assemblage.

The tube system 62 additionally includes part of the drive system 66 for causing rotation of the tube 68 about its longitudinal axis. Specifically, magnets 74 mount to the main body portion of the tube 68. The magnets 74 mount around a section of the outer circumference of the tube 68, preferably proximate to one end of the tube's main body portion.

The magnets 74 are preferably permanent magnets, of the type used in many kinds of conventional electric motors. The magnets 74 are arranged at approximately regular intervals around the tube's circumference as in the arrangement for conventional electrical motors of the type employing permanent magnets on the motor's armature. For increased fluid flow efficiency through the mechanism 60, the magnets 74 are preferably recessed the tube's outer surface, with the outer surface of each magnet flush with the tube's outer surface.

The tube system 62 rotatably mounts within the housing 64. In this regard, the housing 64 generally forms a cylinder or tube shape, substantially surrounding, or enclosing, the tube system 62. The tube system 62 mounts substantially coaxially within the housing 64. In particular, the housing 64 has an internal diameter sufficiently large to accommodate rotation of the tube 68 (and of the external impellers 72 extending from the tube) about the tube's longitudinal axis, without interference.

Bearings (not shown) at either end of the housing 64, receive the necks 69 extending from either end of the tube 68 for permitting tube rotation. The bearings are preferably a commercially available type in which captive fluid or fluid being pumped supplies all necessary lubrication (conventional submersible well pumps typically employ these types of bearings). Hence, the bearings do not have to be "sandwiched" between seals in this embodiment.

The necks 69 thus function as shafts in the bearings for rotatably supporting the tube system 62 (the narrower necks 69, relative to tube's main body portion, permit the use of less costly, smaller bearings). In this mounting arrangement, the ends of the necks 69 are exposed to the environment through the ends of the housing 64.

Additionally, the housing ends include many small perforations, or a grid 76, such that the housing interior is in fluid communication with the environment, through each end of the housing 64. When the tube 68 rotates, the impellers 70 and 72 draw fluid into the housing 64 through the grid 76 in one housing end, and discharge the fluid through the grid in the opposite housing end. The impellers 70 and 72 further cause fluid flow directly through the tube 68, via the necks 69, when the necks are hollow.

The internal impellers 70 are mainly for causing fluid flow directly through the tube 68 via the grids 76. Fluid also may flow through the necks 69 when they are hollow. Conversely, the external impellers 72 are mainly for causing fluid flow along the exterior of the tube 68 via the grid in the housing ends. That is, the external impellers 72 are mainly for causing fluid flow through the mechanism 60 in the space between the exterior of the tube 68, and the internal surface of the housing 64. Also, as illustrated, external impellers 72 on the tube 68, urge fluid flow in the space not occupied by the drive system 66, between adjacent magnets 78 that are mounted to the inside of the housing 64. However, there can be fluid flow within the housing 64, from the interior of the tube 68, to the tube exterior, and vice versa, through the holes 71 in the shoulders of the tube, and/or other holes along the sides of the tube in alternative embodiments.

One or more ends of the housing 64, may include a nozzle 73 for directing fluid flow in a particular direction. The nozzle 73 generally corresponds in shape to a funnel. The large diameter end of the nozzle's funnel-shape mates to an end of the housing 64. The small diameter end of the funnel-shape may connect to piping or other fluid conduit for directing fluid into, or directing fluid from, the housing 64. The nozzle 73 also functions for protecting its respective end of the housing 64.

The drive system 66 includes stationary magnets 78 mounted in the interior of the housing 64, around the tube 68. The stationary magnets 78 are preferably conventional electromagnets, having wiring 80, and a core 81, mounted at approximately regular intervals around a circumferential housing section. Specifically, the stationary magnets 78 mount to a section of the housing interior, opposite the magnets 74 on the tube 68. In operation, the stationary magnets 78 and tube magnets 74 create interacting magnetic fields that cause the tube 68 to rotate.

Each stationary magnet 78 is preferably embedded, or sealed, in a plastic material 82. The plastic material 82 protects the stationary magnets 78 from fluid flowing through the mechanism 64 for preventing electrical shorts, when the pumping fluid is conductive, and also functions to prevent corrosion. As illustrated, the plastic material may be molded to round or smooth abrupt corners for improved fluid flow efficiency through the mechanism 60. Insulated wiring (not shown) extends through the plastic material 82, along the housing wall, for supplying each stationary magnet 78 with electrical power via wiring 84 from an external power source.

As the magnets 74 on the tube 68 are permanent magnets, these magnets do not require a source of electrical power for generating a magnetic field. These permanent magnets 74 thus have an advantage in that they do not require protection from fluid contact for preventing electrical shorts, when the pumping fluid is conductive. The disadvantage, though, is that generally, not as much torque will be available with arrangements employing permanent magnets, relative to comparable arrangements employing only electromagnets.

In alternative embodiments, however, the permanent magnets 74 may be replaced with an inductive system, as in conventional induction electrical motors. In an induction electrical motor, stationary electromagnets act on core elements, mounted on, or within, the motor's armature or rotor, which operate via induced current flow. The result is interacting magnetic forces which cause rotation of the rotor. As there is no direct electrical power supply to the rotor, i.e., electrical power to the rotor is supplied only via induction, there is no need for brushes for supplying electrical power to the rotor.

A similar induction system may accordingly be incorporated into the mechanism 60, as with a conventional induction electrical motor. Since electrical power would be supplied only via induction to the tube, and not through brushes, drive system components on the tube 68 could thus be sealed in plastic or other sealing material for protection against fluid contact. (In alternative embodiments, permanent magnets or inductive arrangements could also be used in the previously described mechanisms 10 and 44).

For pumping applications, the mechanism 60 provides advantages over prior pumping systems, especially in submersible well pumping applications. Most prior submersible pumping systems for use in a well, employ a series of rotating impellers. The impellers coaxially mount in a housing. An electrical motor mounts to the bottom of the housing, and causes rotation of the impellers via one end of the motor's shaft. In use, such prior submersible pumping systems are placed into a well, via the well casing. In the well, fluid enters the housing at entrances between the motor and the section that houses the impellers. Operation of the motor then causes the impellers to pump fluid to the surface, through plumbing in the well casing.

For fluid flow efficiency in these prior pumping systems, the motor must mount to the bottom of the housing that contains the impellers. Specifically, fluid cannot flow through the motor, so the motor must be located in a position out of the fluid flow path. However, locating the motor at the housing bottom, requires electrical cabling extending along the entire length of the impeller section, to the motor. As space is limited in the well casing, the cabling to the motor limits the diameter of the impeller section. Limiting the diameter of the impeller section accordingly reduces the maximum flow rate of fluid available from the pump.

The mechanism 60 has an integral motor and impeller/pump arrangement. That is, pumped fluid effectively flows through the motor. When the mechanism 60 is placed in a well via the well casing, the drive system 66 can thus be located towards the upper end of the mechanism 60, without impairing fluid flow efficiency. The electrical cabling 84 to the drive system 66 therefore does not need to extend along the entire length of the impeller section. Accordingly, the impeller section effectively has a larger diameter, increasing pumping efficiency.

Moreover, the integral impeller/motor arrangement elimiates the shaft coupling between the motor and impellers in many prior systems. As discussed previously, such coupling arrangements introduce frictional losses, take up space, add weight, and can be costly and are subject to mechanical breakdown. The mechanism 60 avoids these drawbacks as it does not employ such a coupling arrangement.

As illustrated, each end of a neck 69 of the tube 68 may extend past its respective end of the housing 64. An extending tube neck 69 can thus be coupled to another device for providing rotational mechanical energy, i.e., for acting as a motor shaft for the other device, as with the first described embodiment. Thus, the mechanism 60 can be staged with other pumping systems, as with the first described embodiment. Moreover, fluid flow through the drive system 66 and through the tube 68, results in improved cooling relative to prior electric motors, when using the mechanism 60 as a motor.

Applications are contemplated for the mechanism 60 for use simply as a flow-through motor. That is, the mechanism 60 drives another device, with fluid flowing through the other device and the mechanism, with no need for the mechanism to cause pumping of the fluid. That is, the pumping is caused by the other device, or systems. Accordingly, in this flow-through motor arrangement, the impellers 70 and 72 in the mechanism 60 may be eliminated.

Figure 7:
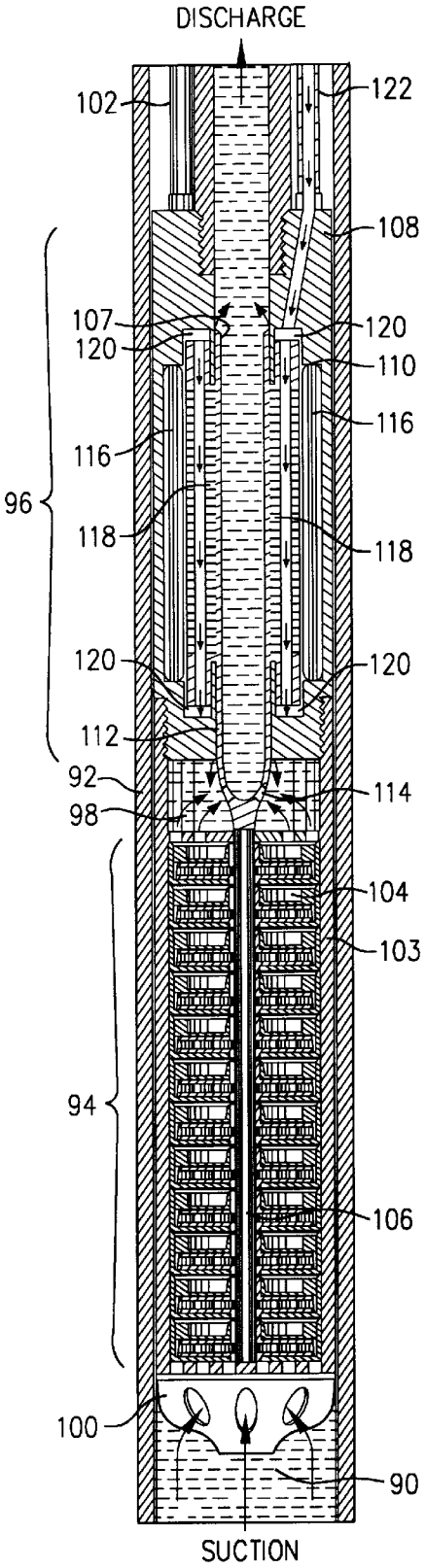
FIG. 7 illustrates another preferred embodiment of a system in accordance with the present invention, having a flow-through motor arrangement.

For instance, FIG. 7 illustrates a preferred embodiment of system 90 in accordance with the present invention, having such a flow-through motor arrangement. FIG. 7 illustrates the system 90 in a submersible well pump application, often called a "down-the-hole" application. That is, where a submersible pumping system is placed in a well, via the well casing. In FIG. 7, reference numeral 92 identifies the well casing in which the system 90 has been placed.

The system 90 includes a pump 94 and a flow-through motor 96 that serves as a power or drive mechanism for the pump 94. The pump 94 is preferably substantially identical to a conventional, submersible, multi-stage centrifugal pump, with one principal exception. The outlet end 98 of the pump 94 connects to the power or drive mechanism (i.e., flow-through motor 96), rather than the inlet end 100 of the pump.

As mentioned previously, most prior submersible well pumping systems have a pump at the top of such systems. The lower end of the pump (i.e., the inlet end), connects to a power or drive mechanism (i.e., electrical motor), which drives the pump. In prior systems, fluid from the well enters the system at entrances between the motor and the pump for pumping the fluid from the well. Considerations of fluid flow efficiency dictate this configuration in such prior systems. More particularly, fluid from the well cannot flow through the motor. Therefore, the pump must be placed above the motor, such that the pump's inlet end connects to the motor.

The system 90, however, employs a flow-through motor 96. Therefore fluid can flow through the motor, and thus the motor may connect to the pump's outlet end 98. Moreover, this is the preferred arrangement. In an arrangement having the motor at the bottom of the system, such as in a prior submersible well pumping system, electrical power cabling must extend along the length of the pump to connect to the motor. As space is very limited in a well casing, the cabling limits the diameter of the pump, and accordingly, reduces the maximum flow rate available from the pump.

In submersible well pump systems for oil, wells are often miles or kilometers deep into the earth. Economic factors require such systems to have high flow rates, and hence, the systems have large pumps and powerful motors. The well casing, however, strictly limits the diameter of the systems. The pumps and motors in such applications are therefore long and narrow for supplying the desired flow rate.

When lowering such a pumping system into a well, the confined space can cause the electrical cabling to rub against the casing as the pumping system is lowered into place. Since the well is often miles or kdlometers deep, and the pumping system itself is several feet or meters long, many times the rubbing will abrade and violate the integrity of the cabling. If this occurs, the pumping system must be removed from the well for repair of the cabling.

For these reasons, the system 90 preferably has a motor 96 at the system's upper end. More particularly, the flow-through motor 96 connects to the outlet end 98 of the pump 94. Consequently, the pump 94 can have a larger diameter for the casing 92 used in a given well, and there is less risk of cable damage when placing the system 90 in a well.

As mentioned, the pump 94 is substantially identical to a conventional submersible centrifugal well pump, except for being modified to connect the pump's outlet end 98 to a motor, rather than the pump's inlet end 100. In this regard, the pump 94 includes a housing 103 enclosing a series of stages or impellers 104. The impellers 104 connect to a shaft 106, rotatably mounted within the housing 103. Rotation of the shaft 106 consequently causes the impellers 104 to rotate for pumping a fluid. In the pump 94, the shaft 106 and housing 103 connect at the pump's outlet end 98 to the flow-through motor 96. In operation, the motor 96 supplies rotational mechanical energy to the shaft 106.

The flow-through motor 96 includes a cylinder or tube system 107, a housing 108, and a power or drive system 110. The tube system 107 includes a tube 112. The tube 112 has a generally constant diameter, but hemispherically narrows at one end to a cap. The distal end of the hemispherical cap is elongated, and attaches to the shaft 106 of the pump 94.

Attachment of the tube 112 to the pump shaft 106 may be by any known conventional method for connecting a first rotating shaft to a second shaft, for causing rotation of the second shaft. Such methods, for instance, may include interfitting splines in the shafts, threads, or other methods. The tube 112 and shaft 106 may also be combined into a single, unitized structure. In operation, fluid from the pump 94 flows into the tube 112 through entrances 114 in the sides of the elongated hemispherical end. Fluid flows out of the tube 112 through the tube's opposite end, which is open.

The tube 112 rotatably mounts in the housing 108. The hemispherical end of the tube 112 projects from one end of the housing for attachment or transition to the pump shaft 106. The end of the motor housing 108 from which the tube 112 projects, preferably connects to the pump housing 103. The method of attachment may be by any known conventional method, for instance, such as threads, splines, or other methods.

The power or drive system 110 for the motor 96, includes stationary magnets 116 mounted to the housing. The magnets 116 are preferably conventional magnets having wiring and a core, positioned around the tube system 106. The drive system additionally includes an inductive rotor system 118, as in the rotor for a conventional induction electrical motor, mounted around the tube 112. In operation, the stationary magnets 116 induce current flow in the rotor system 118, resulting in interacting magnetic forces between the stationary magnets and the rotor system, causing the tube system 107 to rotate. Alternatively, the drive system may employ permanent magnets. The cabling 102 supplies electrical power to the stationary magnets 116.

The flow-through motor 96 may employ hydrostatic radial and thrust bearings and seals 120 as described in U.S. Pat. No. 5,209,650, issued May 11, 1993 to Guy Lemieux, which patent is herein incorporated by reference. This patent describes such bearings and seals as used in an integral motor and pump system. In this regard, the hydrostatic bearings and seals 120 may be used for rotatably mounting the tube system 107 within the motor housing 108. A conduit 122 connected to the flow-through motor 96, supplies seal and bearing fluid.

In use, the flow-through motor 96 supplies rotational mechanical energy to the pump 94 via the motor tube 112. The motor tube 112 operates the pump 94 via the pump shaft 106. The pumped fluid flows into the inlet 100 of the pump 94, and exits at the opposite end of the pump. In this area, the fluid flows into the tube 112 for the flow-through motor 96, and is subsequently discharged at the motor's opposite end. As can be seen, operation of the system 90 does not require impellers in the tube 112 of the flow-through motor 96.

Figure 8:
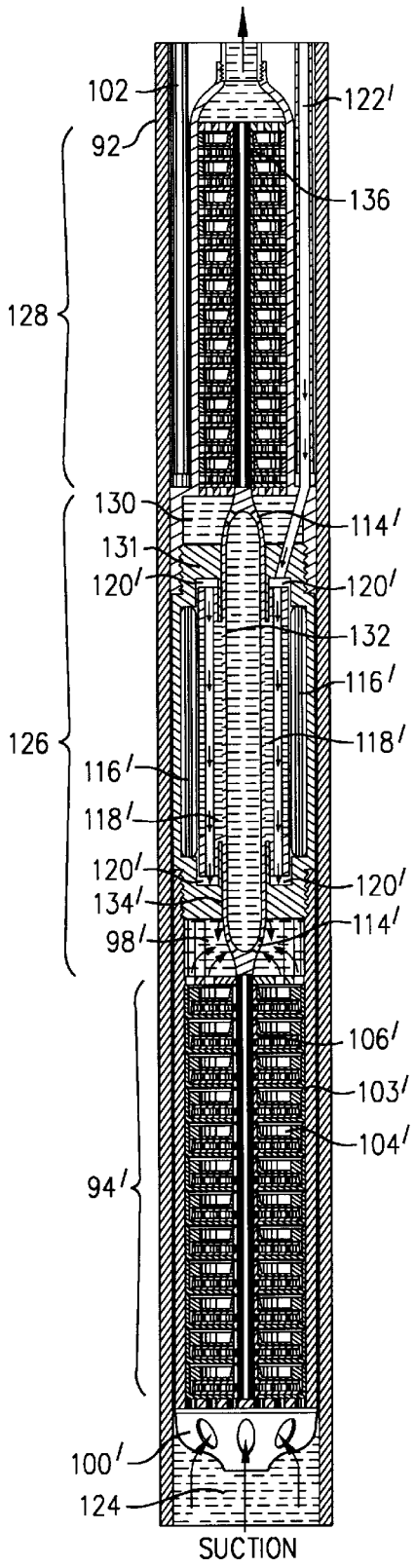
FIG. 8 illustrates another preferred embodiment of a system in accordance with the present invention, having two pumps connected to a flow-through motor arrangement.

FIG. 8 illustrates another preferred embodiment of a system 124 in accordance with the present invention, which is a modification of the system 90 for the previously described embodiment. The modified system 124 includes a flow-through motor 126 serving as the power or drive mechanism for two conventional, multi-stage centrifugal pumps 94' and 128.

One of the pumps 94' is substantially identical to the pump 94 of the system 90, of the previously described embodiment. In this regard, identical reference numerals are used for items or components that are substantially identical to those discussed for a previously described embodiment. The prime symbol (') , however, follows such reference numerals in FIG. 8.

FIG. 8 illustrates the system 124 in a submersible well pump application, placed in a well casing 92'. The lower pump 94' thus is adapted, as discussed with the pump 94 in the previously described system 90, to connect the pump's outlet end 98' to a power or drive mechanism (i.e., the flow-through motor 126).

In operation, the lower pump 94' pumps fluid upward. The fluid passes through the flow-through motor 126 to the inlet end 130 of the upper pump. The upper pump 128 then receives the fluid, further pumping the fluid upward. The upper pump 128 is therefore substantially identical to a conventional, submersible multi-stage centrifugal pump. In particular, the inlet end 130 of the upper pump 128 connects to a power or drive mechanism (i.e., the flow-through motor 126).

The flow-through motor 126 in the modified system 124, is substantially identical to the previously described flow-through motor 96 in the previously described embodiment, with one main exception. Specifically, the flow-through motor 126 is adapted to connect to a pump at both ends. For this purpose, the housing 131 for the flow-through motor 126 is modified to connect to a pump at each end, rather than at one end, as in the previously described embodiment. The method of attachment of the housing 131 is substantially the same as in the previously described embodiment.

Additionally, the flow-through motor 126 has a tube system 132 with a tube 134 hemispherically narrowing at each end to a cap. The distal end of each hemispherical cap is elongated, and attaches to a pump shaft. One of the elongated hemispherical caps attaches to the shaft 106' for the lower pump 94'. The opposite elongated hemispherical end attaches to the shaft 136 for the upper pump 128. The method of attachment to the pump shafts 106' and 136 is the same as in the system 90 for the previously described embodiment. Pumped fluid enters and exits the tube 134 at entrances 114' formed in each elongated hemispherical end. In other aspects, the flow-through motor 126 is substantially identical to the flow-through motor 96 of the previously described embodiment.

As discussed previously, in most prior, comparable pumping systems, the motor is positioned below the pump in a well casing. Fluid enters such prior systems at entrances between the motor and the pump. Fluid flow efficiency dictates such a configuration as the fluid cannot flow through the motor. Hence, the motor must below the pump, since the pump forces the fluid upward through the well casing.

In the system 124 shown in FIG. 8, however, there is a flow-through motor 126. Fluid does flow through the motor 126, so the motor can be above a pump. Therefore, the flow-through motor 126 can drive a pump at both ends. This advantageously provides for dividing the torque between the ends of the motor 126. In prior systems, the motor drives a pump at only one end, which requires one end of the motor shaft to supply all of the torque.

In the present system 124, however, the torque can be divided between opposite ends of the motor for a more versatile pumping system relative to prior systems.

Finally, it should be noted that the upper pump 128 must accommodate cabling 102' and in some instances conduit 122' extending to the motor 126 in the system 124, such that the upper pump 128 has a narrower diameter relative to the lower pump 94'. The modified system 124 nevertheless provides advantages as discussed, and may be more suited for some applications than the previously described system 90.

While preferred embodiments of the invention have been illustrated and described, it will be appreciated that various changes can be made therein without departing from the spirit and scope of the invention. For example, the flow-through motors 96 and 126 could include impellers.

In the embodiments employing flow-through motors 96 or 126, these systems preferably include at least one submersible centrifugal well type pump. In alternative embodiments, other known types of pumps, or even pumps developed in the future, could be substituted for a centrifugal well type pump. Additionally, the hydrostatic bearings and seals in the flow-through motors 96 and 126 could be replaced with other types of bearings and seals as described in connection with other preferred embodiments described herein.

The mechanism 44 described in connection with FIG. 6, employs vane or blade type impellers 48 and 50 external to the tube 18' in the mechanism. In alternative embodiments, the blade type impellers 48 and 50 could be replaced with other types of known impellers, such as centrifugal type impellers, or even with impellers developed in the future.

In other alternative embodiments, the tube 56 of FIG. 2, may have ends that narrow to a neck, as with the tube 68 of FIG. 4. Smaller, and less costly bearings (and seals), could thus be used to rotatably mount the tube. When employing such a tube having necks, the housing for the tube could be modified to have a tubular recess extending from one tube neck to the other. Hence, smaller, less costly, annular seals could be employed for protecting the drive system from electrical shorts when pumping a fluid that is conductive.

The previously described embodiments, preferably employ, at least in part, electromagnets, with each electromagnet having a core, for creating interacting magnetic forces. In alternative embodiments, electromagnets without cores may be employed.

In yet other alternative embodiments, a pneumatic or hydraulic drive system, rather than an electromagnetic drive system may be employed. For instance, in the mechanisms 10 and 44 of FIGS. 3 and 6, the magnets may be replaced with impellers mounted to the exterior of the tube, within the housing's tubular recess. A fluid could then be injected into an opening at one end of the tubular recess, and received at another opening. As the fluid passes through the tubular recess, the fluid would act against the tube's external impellers, causing the tube to rotate.

The embodiments described above, preferably employ an integral impeller/pump and drive system arrangement for causing an internal tube to rotate. In yet other alternative embodiments, other systems may be employed for causing the tube to rotate. For example, a motor in the housing for the various embodiments could be used, mounted to one side of the tube, which rotates the tube via gearing, rollers, belts, or other arrangement. While these particular alternative embodiments may have the disadvantage of requiring a coupling mechanism between a tube and a motor, it still provides advantages. By way of non-limiting, illustrative example, such a mechanism would function in general for providing motive force, and in particular for pump system applications.

In view of the alterations, substitutions and modifications that could be made by one of ordinary skill in the art, it is intended that the scope of letters patent granted hereon be limited only by the definitions of the appended claims.

The embodiments of the invention in which an exclusive property or privilege is claimed are defined as follows:

1. A system for fluid pumping, the system comprising:

(a) a power unit, the power unit including:

(i) a housing having a stator mounted to an interior surface thereof;

(ii) a tube having a longitudinal axis, the tube being rotatably mounted within the housing for rotation of the tube relative to the housing, substantially about the longitudinal axis of the tube;

(iii) a plurality of magnets located around the tube, for creating magnetic forces for causing the tube to rotate relative to the housing; and (b) a pumping unit, the pumping unit receiving rotational mechanical energy from the tube when the tube rotates, for supplying motive force for operating the pumping unit, the pump unit being in fluid communication with the tube, such that when the system pumps a fluid, the fluid flows first through one of the units, and then through the other unit.

2. The system of claim 1, wherein the pumping unit includes an inlet for receiving fluid into the pumping unit, and an outlet for discharging fluid, with the outlet from the pumping unit connected in fluid communication to the tube.

3. The system of claim 1, further comprising at least one impeller mounted to the tube, the impeller being adapted to cause fluid to flow through the tube when the tube is rotated relative to the housing.

4. The system of claim 1, wherein the tube and the pumping unit serially connect in fluid communication with each other, such that when the system pumps a fluid, the fluid first flows through the pumping unit and then through the tube.

5. The system of claim 1, wherein at least some of the magnets are permanent magnets.

6. The system of claim 1, wherein at least some of the magnets are electromagnets.

7. The system of claim 1, further comprising another pumping unit, wherein the tube includes a first end, and a second end opposite the first end, with one pumping unit being connected to the first end of the tube, and the other pumping unit being connected to the second end of the tube, wherein the tube and pumping units are in fluid communication, such that when the system pumps a fluid, the fluid flows through the pumping units and the tube.

8. The system of claim 7, wherein each pumping unit includes an inlet for receiving fluid into the pumping unit, and an outlet for discharging fluid, with the inlet of one pumping unit being connected to the tube, and the outlet of the other pumping unit being connected to tube.

9. A system for placement in a well having a fluid therein, for pumping fluid from the well, the system comprising:

(a) a pump having opposite ends, with one end having an inlet for receiving fluid from the well into the pump, and the other end having an outlet for discharging the fluid from the pump, the pump being placed in the well with the outlet above the inlet, when the system is operated; and (b) power means for supplying rotational mechanical energy to the pump, when the system is operated, the power means including an inlet and an outlet, with the power means inlet being connected in fluid communication with the pump's outlet such that when the system operates, fluid discharged from the pump enters the power means inlet, and exits through the power means outlet, the power means including a housing having a stator mounted to an interior surface thereof.

10. The system of claim 9, wherein the power means includes a tube rotatably mounted within the housing, with the tube connected in fluid communication to the pump's outlet.

11. The system of claim 9, further comprising at least one impeller mounted to the power means, the impeller being adapted to cause fluid to flow through the power means when the tube is rotated relative to the housing.

12. The system of claim 10, wherein the tube includes both an inner and outer surface, and has at least one impeller mounted to the inner surface of the tube, and at least one impeller mounted to the outer surface of the tube.

13. The system of claim 9, wherein the power means includes a rotatably mounted tube, and a plurality of magnets located around the tube, that create magnetic forces and cause the tube to rotate when the system is operated.

14. The system of claim 9, wherein the thrust loads of the pump and the power means are carried by a bearing or bearings located in the pump.

15. The system of claim 9, wherein the thrust loads of the pump and the power means are carried by a bearing or bearings located outside of the pump.

16. The system of claim 9, further comprising another pump having opposite ends, with one end having an inlet for receiving fluid from the well into the pump, and the other end having an outlet for discharging the fluid from the pump, wherein the power means attaches to the outlet end of one pump, and the inlet end of the other pump.

17. A mechanism for pumping a fluid, the mechanism comprising:

(a) a housing;

(b) a tube having a longitudinal axis, the tube being rotatably mounted within the housing for rotation of the tube relative to the housing, substantially about the longitudinal axis of the tube;

(c) a plurality of magnets located around the tube, for creating magnetic forces for causing the tube to rotate relative to the housing;

(d) at least one impeller mounted to the tube for causing a fluid to be pumped through the mechanism; and (e) fluid flow path defining means within the housing, for defining the flow path of fluid through the mechanism, the fluid flow path being at least partially within the tube, and at least partially external to the tube, the fluid flow path defining means including a space, extending at least partially along the length of the tube, between the housing and the exterior of the tube, trough which fluid flows when the mechanism is operated for pumping a fluid.

18. The mechanism of claim 17, wherein the tube includes a side, and the fluid flow path defining means includes at least one aperture defined in the side of the tube.

19. The mechanism of claim 17, wherein the tube includes internal and external surfaces, and fluid flow path defining means includes at least one impeller mounted to the internal surface of the tube, and at least one impeller mounted to the external surface of the tube.

20. A mechanism for pumping a fluid, the mechanism comprising:

(a) a tube having a longitudinal axis, the tube being rotatably mounted for rotation of the tube, substantially about the longitudinal axis of the tube;

(b) a plurality of magnets located around the tube, for creating magnetic forces for causing the tube to rotate;

(c) at least one impeller mounted to the tube for causing a fluid to be pumped through the mechanism; and (d) a housing in which the tube is rotatably mounted, the housing having an inlet that receives fluid into the housing, and an outlet that discharges fluid from the housing when the mechanism operates to pump a fluid, the inlet and outlet being defined at positions in the housing, located away from, and being non-aligned with, the longitudinal axis of the tube.

21. The mechanism of claim 20, wherein the mechanism is for resting on a surface when the mechanism is operated to pump a fluid, the housing including at least one foot for supporting the mechanism on the surface.

22. The mechanism of claim 20, wherein the housing includes an exterior wall, the mechanism further including shaft means connected to the tube, and extending through the exterior wall of the housing, and projecting from the mechanism, for connection to another device.

* * * * *